US012139795B1

(12) United States Patent
Alsayegh et al.

(10) Patent No.: US 12,139,795 B1
(45) Date of Patent: Nov. 12, 2024

(54) QUENCHING AND COATING METALS USING GOLD-BASED EFFERVESCENT TABLETS

(71) Applicant: KUWAIT UNIVERSITY, Safat (KW)

(72) Inventors: Naser Alsayegh, Safat (KW); Nawaf F. Aljuwayhel, Safat (KW); Husain Bahzad, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 18/382,254

(22) Filed: Oct. 20, 2023

(51) Int. Cl.

| | |
|---|---|
| ***C23C 24/00*** | (2006.01) |
| ***B22F 1/05*** | (2022.01) |
| ***B22F 1/054*** | (2022.01) |
| ***C21D 1/18*** | (2006.01) |
| ***C22F 1/00*** | (2006.01) |

(52) U.S. Cl.
CPC ..... *C23C 24/00* (2013.01); *B22F 1/05* (2022.01); *B22F 1/054* (2022.01); *C21D 1/18* (2013.01); *C22F 1/002* (2013.01); *B22F 2301/255* (2013.01)

(58) Field of Classification Search
CPC ..... B82Y 30/00; C22F 1/002; B01J 13/0043
See application file for complete search history.

(56) References Cited

U.S. PATENT DOCUMENTS

| | | | | |
|---|---|---|---|---|
| 10,184,025 | B2 | 1/2019 | Ichikawa et al. | |
| 11,226,335 | B2 | 1/2022 | Day et al. | |
| 11,866,610 | B2 * | 1/2024 | Alsayegh | C23C 18/42 |
| 2002/0062888 | A1 * | 5/2002 | Stratton | C21D 1/60 148/660 |
| 2010/0290043 | A1 | 11/2010 | White et al. | |
| 2012/0145554 | A1 * | 6/2012 | Liu | C23C 18/206 205/187 |
| 2012/0225021 | A1 | 9/2012 | Qian et al. | |
| 2013/0189592 | A1 | 7/2013 | Roumi et al. | |
| 2014/0024026 | A1 | 1/2014 | Alocilja et al. | |
| 2014/0288194 | A1 | 9/2014 | Niedermeyer | |
| 2015/0110882 | A1 | 4/2015 | Ichikawa et al. | |

FOREIGN PATENT DOCUMENTS

| | | | |
|---|---|---|---|
| CN | 106350328 A | * | 1/2017 |

* cited by examiner

*Primary Examiner* — Samir Shah
*Assistant Examiner* — Sean P. O'Keefe
(74) *Attorney, Agent, or Firm* — Nath, Goldberg & Meyer; Joshua B. Goldberg

(57) ABSTRACT

An effervescent suspension for metallic quenching and coating purposes, is implemented by providing and an effervescent tablet with mixture comprising a solid alkaline, a solid acid, and noble metal particles. The mixture is added to water to produce a reaction in the water resulting in the release of $CO_2$ gas, which disperses the noble metal particles in the water to provide a suspension. A hot metal material, having a temperature below its melting point, is immersed in the suspension to provide a quenched metal that has a temperature below its melting point in the suspension to provide a quenched metal coated with noble metal particles. The solid alkaline may comprises sodium bicarbonate ($NaHCO_2$) powder and sodium carbonate ($Na_2CO_3$) powder. The solid acid may comprise monosodium phosphate ($NaH_2PO_4$) powder.

9 Claims, 7 Drawing Sheets

QUENCHING AND COATING METALS USING GOLD-BASED EFFERVESCENT TABLETS

BACKGROUND

Technical Field

The present disclosure relates to metallic quenching and coating applications. Described techniques include dispersion, carbonated quencher, and ball milling.

Background Art

Existing processes for producing noble metal particles and noble metal nanoparticles use chemical reactions to release noble metal particles. Noble metals, as used herein, refer to gold and other noble metals, including platinum group metals and silver. Additionally, noble metals are sometimes used to more broadly describe any metallic or semimetallic element that does not react with a weak acid and give off hydrogen gas in the process. This broader set includes, copper, mercury, technetium, rhenium, arsenic, antimony, bismuth and polonium, as well as gold, the six platinum group metals Pt, Ru, Rh, Pd, Os, Ir (platinum, ruthenium, rhodium, palladium, osmium, iridium), and silver.

Suspensions are advanced types of fluids that contain dispersed solid particles. These particles are usually in the range of nanometers (nm) to micrometers (μm) in size. Furthermore, when suspensions are fabricated from particles in the nanoscale they can be referred to as "nanofluids", whereas the ones made of microns or micrometers (μm) dispersions can be termed as "microfluids". Such advanced types of fluids are generally targeted towards heat transfer applications; e.g., heat exchangers working fluids, but can also be utilized by the medical sector in the form of medications or inner body diagnostic fluids; e.g., radioactive technetium imaging. Other applications are in the petroleum industry to improve fuel products combustion efficiency or enhance the crude oil recovery at the flooding stage, and as lubricants for mechanical parts.

There are two common approaches to produce these suspensions. The first route is known as the one-step or single-step method, and the second technique is called the two-step method. In the single-step approach, the particles are formed and dispersed within the hosting fluid in a single stage. The advantages of such approach are:

1. suspension has higher dispersion physical stability, and
2. avoid the need to deal with dry powder, their transport, and storage allocation.

It is noted that this method of production is associated with residuals that are difficult to remove, because of incomplete reactions. The method can only be used to fabricate specific combinations of particles and base fluids (e.g., they cannot be used to produce diamond-water suspensions), and in most cases are very complicated and time consuming.

Known one-step suspension fabrication methods include:

1. Vacuum evaporation onto a running oil substrate (VEROS).
2. Submerged arc nanoparticle synthesis system (SANSS).
3. Phase transfer approach.
4. Physical vapor condensation.
5. Laser ablation.
6. Microwave irradiation.
7. Polyol method.

8. Plasma discharge.
9. Electrical explosion of wire.

Alternatively, the two-step method uses pre-prepared powders, after which they are added and dispersed in any non-dissolving base fluid through a mixing device, such as ultrasonicator, homogenizer, magnetic stirring, and/or high energy ball (or rod) milling. The advantages of this approach are that any type of suspension can be manufactured, is easy to handle by users with minimum level of experience, the powders are commercially available on a wide scale, and can be used for both small- and large-scale production. Due to the previous advantages, this method of production has been favored by many researchers in the field of advanced fluids. Nevertheless, a downside of this method (i.e., the two-step approach) of suspension production is that the resulting mixture could occasionally have less level of dispersion physical stability than the one-step method; but this can be improved to a certain extent by including surfactants with the mixture at the fabrication stage or by employing surface functionalization to particles.

On the other hand, a quenching process is used to improve the mechanical properties of the as-prepared metallic part. This is done by initially heating the metal to its solution treatment temperature, homogenize the heated alloy through soaking it, and then exposing the metallic part to an appropriate heat transfer media (also known as a quenchant) to cool it down. Furthermore, the common cooling media in a quenching process are water and oil. This because these types of liquids are widely available, easy to handle, and of low cost.

Some disadvantages of using these two types of quenching liquids are:

1. Water:
   a. High cooling severity.
   b. Lack of wettability.
   c. High air pockets formation on the quenched metal exposed surface.
   d. Uneven heat transfer distribution along the quenched part, which result in an uneven size expansion to the final product.
2. Oil:
   a. Requires different types and concentrations of chemical additives to remove the undesired residuals of the final product surface.
   b. Needs additives that can provide anti oxidation to the quenched metal.
   c. Requires thermal stabilizers for even heat transfer mechanism along the quenched part.

It has been shown that using carbonated water as a quenchant helps in reducing the geometrical expansion of the final product. This is because the carbon dioxide ($CO_2$) bubbles within the water media reduces the formation of the air pockets on the quenched metal exposed surface, and hence an even heat transfer between the metal and the surrounding liquid can be achieved. Furthermore, when it comes to quenching metals in suspensions, the hot metallic surface will attract the dispersed particles from the host liquid, and thus forming a permanent attached thin film layer. The aforementioned mechanism is similar to the inner pipes foiling formation caused by suspension flowing at elevated temperature conditions.

US Published Patent Application No. 2014/0024026 A1 to Alocilja, et al., describes a method for producing nanoparticles and their dispersions. That reference describes fabrication of gold nanoparticles using a suspension including the gold particles, sodium carbonate, and an acid. The gold/base/acid combination is added to pure water to start a chemical reaction which releases the gold particles. The gold particles disperse within the base fluid, thus forming a gold-carbonated water suspension quencher used for metallic quenching and coating applications.

More generally, it is known to fabricate nanoparticles, functionalize these nanoparticles, and form suspensions of nanaoparticles.

SUMMARY

A method for fabricating an effervescent suspension for metallic quenching and coating purposes is implemented by providing water in a container and providing a mixture comprising a solid alkaline, a solid acid, noble metal particles, the noble metal particles being selected from the group consisting of microparticles and nanoparticles. The mixture is added to the water to produce a reaction in the water resulting in the release of $CO_2$ gas, and the $CO_2$ gas disperses the noble metal particles in the water to provide the suspension. A hot material such as a metal or other material to which the noble metal will adhere, is heated to a temperature below its melting point, in the suspension, and is immersed to provide a quenched metal that has a temperature below its melting point in the suspension to provide a quenched metal coated with noble metal particles.

As used herein, noble metals, in addition to gold and platinum, include the other platinum group metals (ruthenium, rhodium, palladium, osmium, iridium), as well as silver. Additionally, the noble metal may include a broader set, including copper, mercury, technetium, rhenium, arsenic, antimony, bismuth and polonium, although in the case of mercury, coating may be impractical.

In non-limiting examples, the noble metal particles may comprise of different percentages of noble metal microparticles or noble metal nanoparticles with other micro or nano metallic particles, e.g., copper, silver, nickel, cobalt, rhodium, aluminium, palladium, and cadmium, depending on the desired coated layer color and carat standard. Thus, in the case of gold, the noble metal particles may comprise of different percentages of gold microparticles or gold nanoparticles with other micro or nano metallic particles, e.g., copper, silver, nickel, cobalt, rhodium, aluminium, palladium, and cadmium, depending on the desired coated layer color and carat standard. The noble metal particles may comprise a single noble metal such as pure gold, or may comprise a noble metal and one or more alloy metals. The solid alkaline may comprises a material selected from the group consisting of sodium bicarbonate ($NaHCO_2$) powder and sodium carbonate ($Na_2CO_3$) powder. The solid acid may comprise monosodium phosphate ($NaH_2PO_4$) powder.

In further non-limiting examples, the mixture may comprise an effervescent tablet formed by mixing an acid powder and an alkaline powder to form a first mixture component, mixing an acid powder, an alkaline powder, and noble metals powder to form a second mixture component, and providing a tablet press with a die for compressing the powder into an effervescent tablet.

BRIEF DESCRIPTION OF THE DRAWINGS

FIG. 1A is a schematic diagram showing the process flow. FIG. 1B is a graphic depicting the output mass flow of byproducts at different temperatures.

FIG. 2A shows decorated CNTs. FIG. 2B shows decorated graphene. FIG. 2C shows gold particles attached with other alloy particles via CNT or graphene links.

FIG. 3A illustrates a reactive ball milling vial and gold-based mixing balls. FIG. 3B illustrates a high energy reactive ball milling functionality mechanism. FIGS. 3C and 3D schematically shows the inner vial mixing operation, with FIG. 3C showing the inner vial operation and FIG. 3D showing details of the interaction of the noble metal balls such as gold balls, with other alloy particles, with the effervescent agents. FIG. 3E shows the effervescent tablets after been constructed from the as-prepared powder mixture.

FIG. 5A shows the original uncoated rod. FIG. 5B shows the rod with a gold-based coated section resulting from quenching in the effervescent solution and coated by the proposed approach.

DETAILED DESCRIPTION

Overview

Figure 1A:
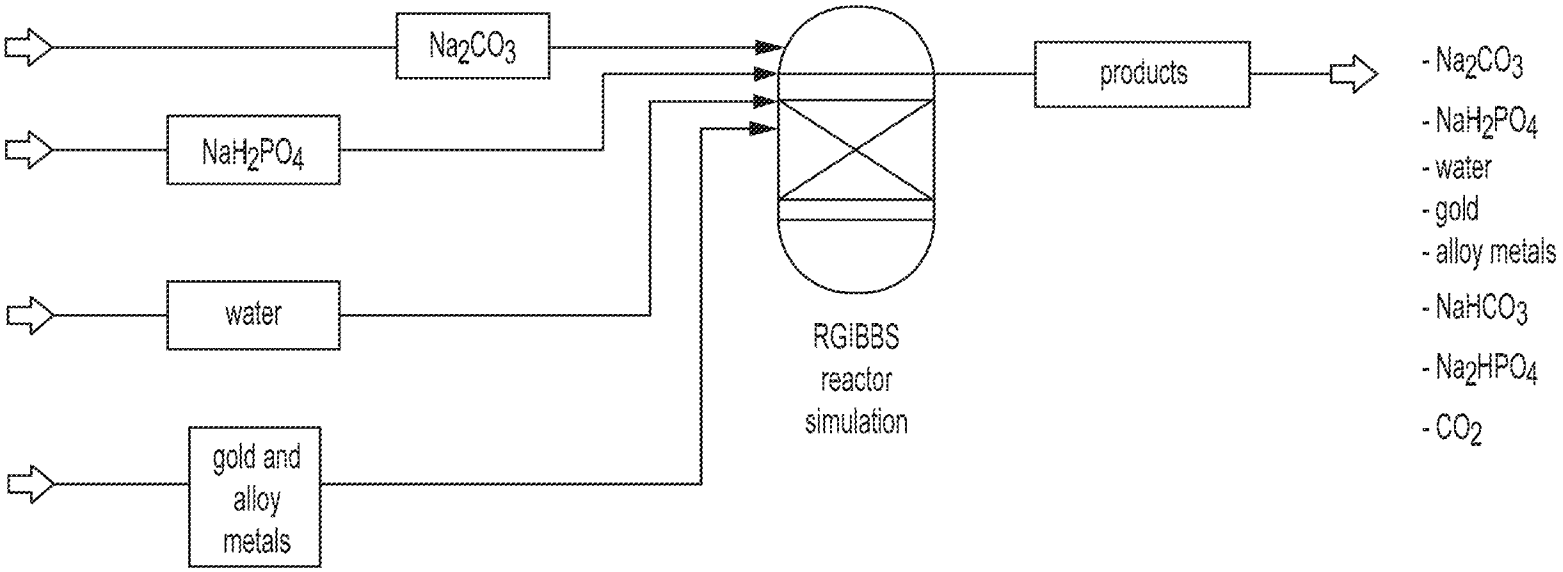
FIGS. 1A and 1B show the gold coating process.

The present disclosure relates to a technique for producing gold of different carat and apparent color or other noble metal dispersions that depends in its formation using an effervescent tablet or solution. Carbonates and bicarbonates as effervescent agents are used to generate $CO_2$ bubbles. The $CO_2$ bubbles are used as a driving or agitation force for mixing and dispersing the nanoparticles within a host base fluid or liquid to form a suspension within a host base fluid or liquid. The formed suspension can be used for a quenching application and can be used for coating of an external bulk material. This allows coating of bulk materials with precious materials (e.g., gold of different carat and apparent color) that were originally dispersed as particles (e.g., AuNP with other alloys) in a host base fluid (i.e., water) using the effervescent tablet technique, in which the effervescent tablet facilitates forming the suspension. The base fluid and the effervescence tablet content further results in quenching the bulk material or targeted part, which result in the formation of the coating layer on its outer surface and the fixing or adhering of the coating material on the outer surface.

As used herein, noble metals, in addition to gold and platinum, include the other platinum group metals (ruthenium, rhodium, palladium, osmium, iridium), as well as silver. Additionally, the noble metal may include a broader set, including copper, mercury, technetium, rhenium, arsenic, antimony, bismuth and polonium, although in the case of mercury, coating may be impractical. The gold coated layer can be of different carat (e.g., 24, 22, 18 carat . . . etc.) and of different finishing colour (i.e., yellow, white and grey, pink and red, green, black, blue, and purple).

By way of non-limiting example, pre-prepared tablets are used to form a suspension. The carbonates and bicarbonates are used as effervescent agents to generate $CO_2$ bubbles, which are the main driving force for mixing and dispersing the non-dissolving solid particles within the host base fluid or liquid to form the suspension. The technique provides an approach for fabricating gold-based carbonated water suspensions, as a quenchant, for metallic quenching and coating purposes.

This approach, by way of non-limiting example, uses pre-prepared tablets that are made of homogeneously mixed then compressed separate particles of gold and other alloys in the form of particles, decorated carbon nanotubes (CNTs) with gold particles and other alloys in the form of particles, decorated graphene with gold particles and other alloys in the form of particles, or attached particles of gold with other alloy particles via embedded CNTs links along with sodium carbonate powder, and monosodium phosphate powder. The gold particles would be combined with other alloy particles to have a resulting coating layer of different carat and color. The particles can be placed as separate particles within the mixture before being compressed, or via the decoration of CNTs or graphene (i.e., the CNTs or graphene will host the particles), or CNTs can be embedded in the gold and other alloy particles to connect them together. The CNTs embedded method and the CNTs and graphene decoration approach are available in the literature.

Alternatively a single noble metal can be provided, which would result in a coating of the single noble metal.

Furthermore, the manufactured tablet is utilized by adding it to pH-controlled water, pure water, deionized water, or hydrogen peroxide to start a chemical reaction, which then results in generating $CO_2$ bubbles and releasing the gold-based particles. The bubbles then cause the host liquid to carbonate along with the gold and other alloys particles to disperse within the base fluid, and thus forming the gold-based-carbonated water suspension quencher used for metallic quenching and coating applications. This proposed approach is easy to use and reduces the possibility of geometrical expansion to the quenched part while providing a gold-based thin film on the outer surface part. While gold of different carat and colors is given as a non-limiting example, the process can be used for coating with other noble and/or platinum-group metals, and for coating with other metals.

The use of the pre-prepared tablets provides a system and method for forming gold-based-carbonated water suspensions, as a quenchant, for metallic quenching and coating purposes which uses pre-prepared tablets that are made of homogeneously mixed then compressed gold with other alloys particles, sodium carbonate, and monosodium phosphate. The manufactured tablet is utilized by adding it to pure water to start a chemical reaction which then results in generating $CO_2$ bubbles and the releasing of gold with the other alloys particles. The $CO_2$ bubbles then cause the host liquid to carbonate and those causes the gold with the other alloys particles to disperse within the base fluid, and thus form the gold-based-carbonated water suspension quencher used for metallic quenching and coating applications.

The disclosed technology presents an approach for quenching and coating metals using carbonated water gold (Au)-based suspensions. The carbonated water-Au-based suspension quenchant is formed by only adding a pre-prepared solid tablet to a reactive liquid, e.g., water. The selection of Au particles provides advantages in that this noble metal has high resistance to water, acidic, and alkaline environments as well as providing a valuable cost to the quenched part. Furthermore, the proposed method for fabricating the advanced quenchant can be considered as a one-step suspension production approach since no mixing device is required in the process.

A method for fabricating an effervescent suspension for metallic quenching and coating purposes is implemented by providing water in a container and providing a mixture comprising a solid alkaline, a solid acid, and noble and/or platinum-group metal particles. The mixture is added to the water (or a reactive liquid) to produce a reaction in the water resulting in the release of $CO_2$ gas, $CO_2$ gas dispersing the noble and/or platinum-group metal particles in the water to provide the suspension. A hot material, such as a hot metal, that has a temperature below its melting point, in the suspension, is immersed. This provides a quenched metal that has a temperature below its melting point in the suspension to provide a quenched metal coated with noble and/or platinum-group metal particles. The noble and/or platinum-group metal particles can comprise gold microparticles or gold nanoparticles along with other micro or nano metallic particles, e.g., copper, silver, nickel, cobalt, rhodium, aluminum, palladium, and cadmium, depending on the desired coated layer color and carat standard.

In one example of the technique, the solid alkaline comprises a material selected from the group consisting of sodium bicarbonate ($NaHCO_3$) powder and sodium carbonate ($Na_2CO_3$) powder. The solid acid comprises monosodium phosphate ($NaH_2PO_4$) powder.

In one example of the technique, the mixture comprises a tablet formed by mixing an acid powder and an alkaline powder to form a first mixture component, mixing an acid powder, an alkaline powder, and noble and/or platinum-group metal powders to form a second mixture component, and providing a tablet press with a die for compressing the powder into an effervescent tablet.

In one example of the technique, the tablet comprises a mass ratio of $NaH_2PO_4$ to $Na_2CO_3$ to gold (Au) with other alloys particles of 20.4:6:1.

Process

Figure 1B:
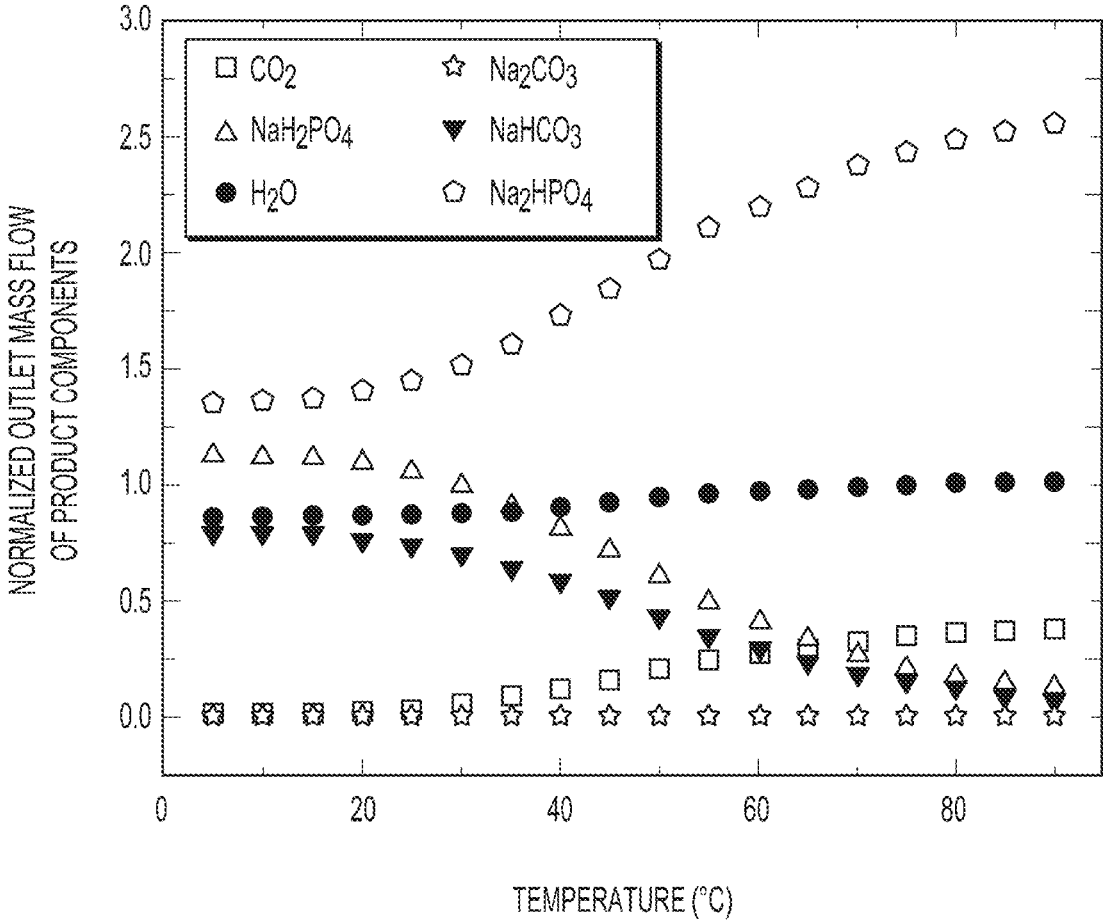

FIGS. 1A-and 1B show the disclosed coating process, used for gold coating. FIG. 1A is a schematic diagram showing the process flow. FIG. 1B is a graphic depicting the output mass flow of byproducts at different temperatures. These figures shows the chemical reaction process of the tablet content with water and their bi-products using an Aspen Plus™ reactor simulation tool (version 9) developed by AspenTech, Bedford, Massachusetts, USA, running the RGIBBS simulation model.

The reactions depicted in FIGS. 1A and 1B are given as theoretical chemical reaction simulations using Aspen Plus™. FIG. 1A shows the investigated components in an RGIBBS reactor and their chemical outcomes. FIG. 1B demonstrates the normalised outlet mass flow of different bi-products at 5° C. to 90° C. It is noted that the normalised outlet mass flow in FIG. 1B was calculated by dividing the mass flow of the product component (e.g., $CO_2$) by the inlet mass flow of $Na_2CO_3$.

In a first stage, the effervescent tablets are fabricated. This is done by adding a solid alkaline, such as sodium bicarbonate ($NaHCO_3$) or sodium carbonate ($Na_2CO_3$), with a solid acid and Au with other alloys in the form of standalone particles, decorated particles on the pores of the CNTs or graphene sheets, or interconnected particles via embedded CNTs links in a high energy reactive ball milling vial. The particles of Au and the other alloys can be provided as microparticles or nanoparticles. A non-limiting example of a solid acid used to form the solid acid is solid acid powder in the form of monosodium phosphate ($NaH_2PO_4$). The mass ratio of the described solid powders can vary; i.e., based on desired manufacturing processes but as a non-limiting example, the mass ratio of $NaH_2PO_4$ to $Na_2CO_3$ to Au with other alloys particles is 20.4:6:1, respectively. The aforementioned ratio was selected based on a simulation investigation that was performed in the Aspen Plus™ simulation tool.

The equilibrium composition of the products formed was calculated by minimizing the Gibbs free energy using the Aspen Plus™ RGIBBS reactor model depicted in FIG. 1A. It was found that the previous inlet acid/base ratio obtains the highest $CO_2$ generation. In addition, a sensitivity analysis was performed to study the effect of reactor temperature on the products composition and $CO_2$ generation. From the simulation results, presented in FIG. 1B, it was concluded that increasing the temperature at which the reaction takes place would lead to an increase in $CO_2$ generation. The reason behind this is attributed to the endothermic nature of reactions (Equation 1 and 2), thus raising the temperature will shift the reaction toward the $CO_2$ formation:

$$Na_2CO_3+NaH_2PO_4 \rightarrow NaHCO_3+Na_2HPO4 \quad \text{(eqn. 1)}$$

$$NaHCO_3+NaH_2PO_4 \rightarrow CO_2+H_2O+Na_2HPO_4 \quad \text{(eqn. 2)}$$

The reactions are such that the balls that are used to mix the solid powders along with the high energy ball milling vial are advantageously made of gold of selected carat and color; i.e., similar to the main metallic powder elements of interest. The reason behind the aforementioned is that, in a high energy ball milling process the centrifugal force causes the ball to not only mix the powder but also to collide into each other and onto the inner vial surface. This collision (or impact) causes the outer surface of the balls and the inner vial surface to erode. Therefore, if the balls or the inner vial surface material are different from the main metal powder of interest, the resulting mixed powder will contain undesired metallic residuals from the cracking of balls and/or vial inner surface. The mixing duration can vary from short durations (e.g., 15 min) and up to days. Accordingly, it depends on the process design choice and how homogeneously the one wants to distribute the solid feedstocks into each other. Once all the solid powders are mixed, they are removed and placed in a tablet press instrument, where the solid powder mixture is mechanically compressed into a tablet.

Figure 2A:
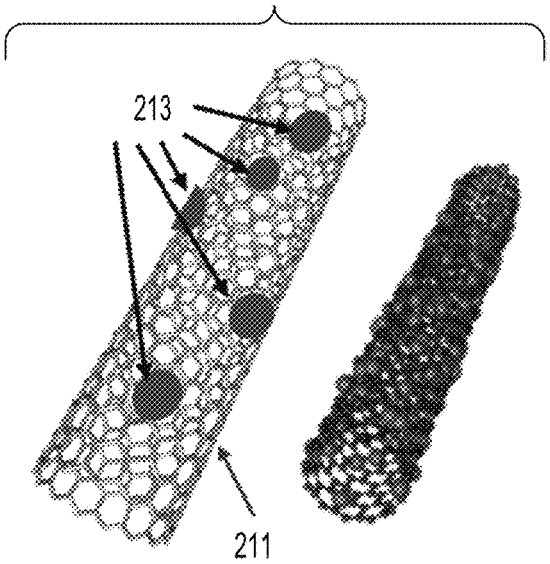
FIGS. 2A-2C are schematic diagrams showing the use of decorated carbon nanotubes (CNTs), decorated graphene and the attachment of gold particles with other alloy particles via CNT or graphene links.
Figure 2B:
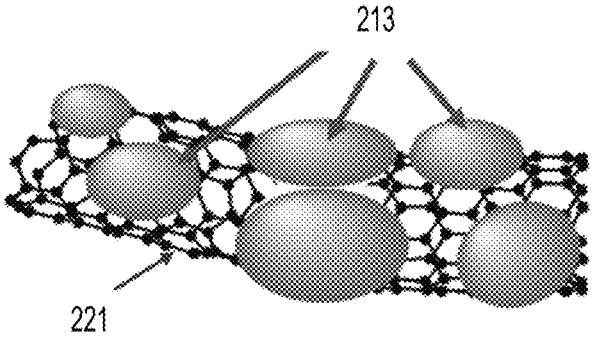
Figure 2C:
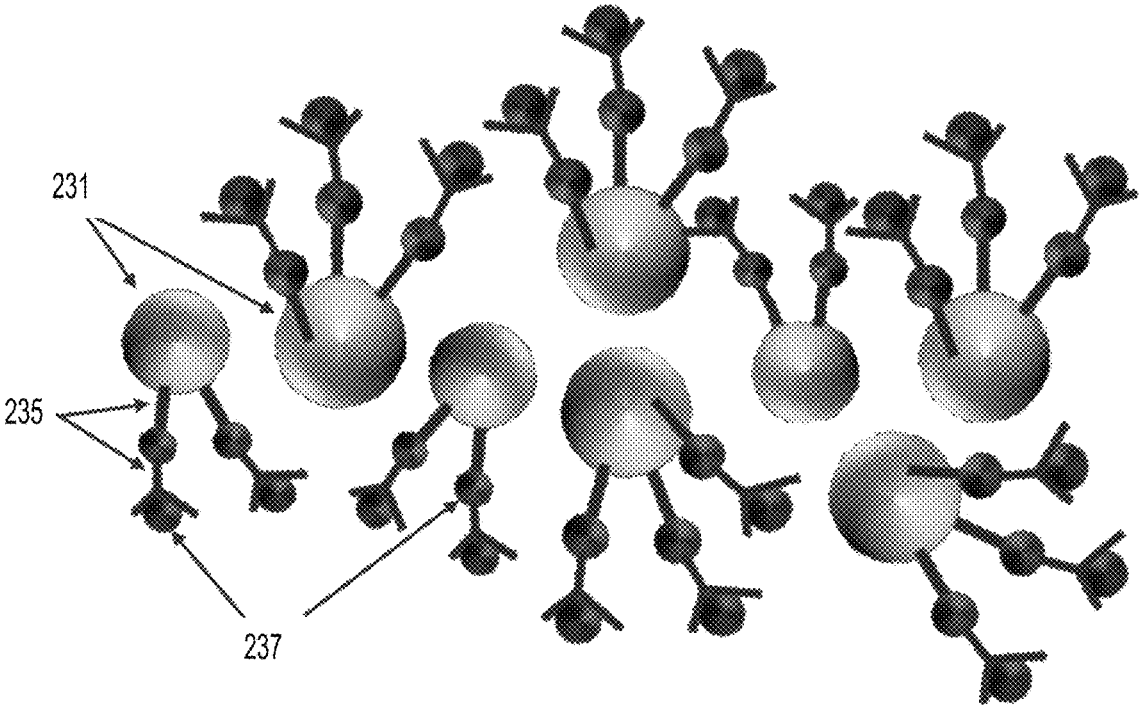

FIGS. 2A-2C are schematic diagrams showing the use of decorated carbon nanotubes (CNTs), decorated graphene and the attachment of gold particles with other alloy particles via CNT or graphene links. FIG. 2A shows decorated CNTs. FIG. 2B shows decorated graphene. FIG. 2C shows gold particles attached with other alloy particles via CNT or graphene links.

Referring to FIG. 2A, carbon nanotube 211 are decorated with gold or other alloy particles 213. In FIG. 2B, graphene layer 221 are decorated with the gold or other alloy particles 213. In FIG. 2C gold particles 231, corresponding to gold particles 213, are linked with CNT links 235, obtained from CNT 211. Other alloy particles 237 are attached by being supported by CNT links 235. The structure using graphene is the same, except that graphene forms the links corresponding to CND links 235.

Figure 3A:
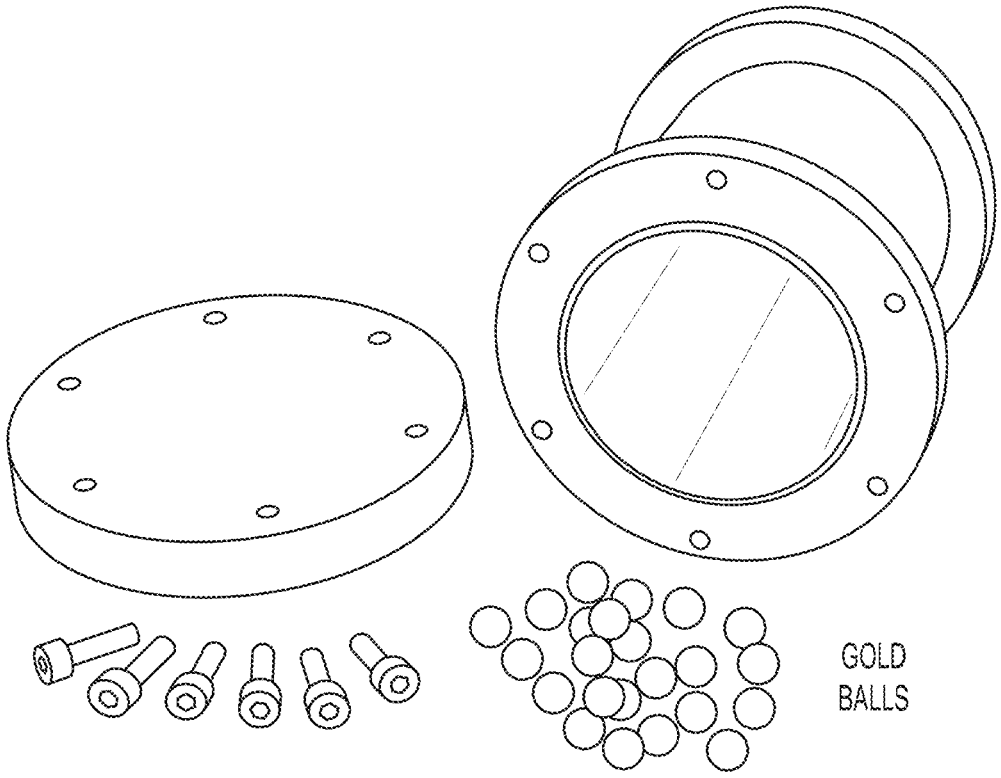
FIGS. 3A-3E are schematic diagrams showing the tablet fabrication process.
Figure 3B:
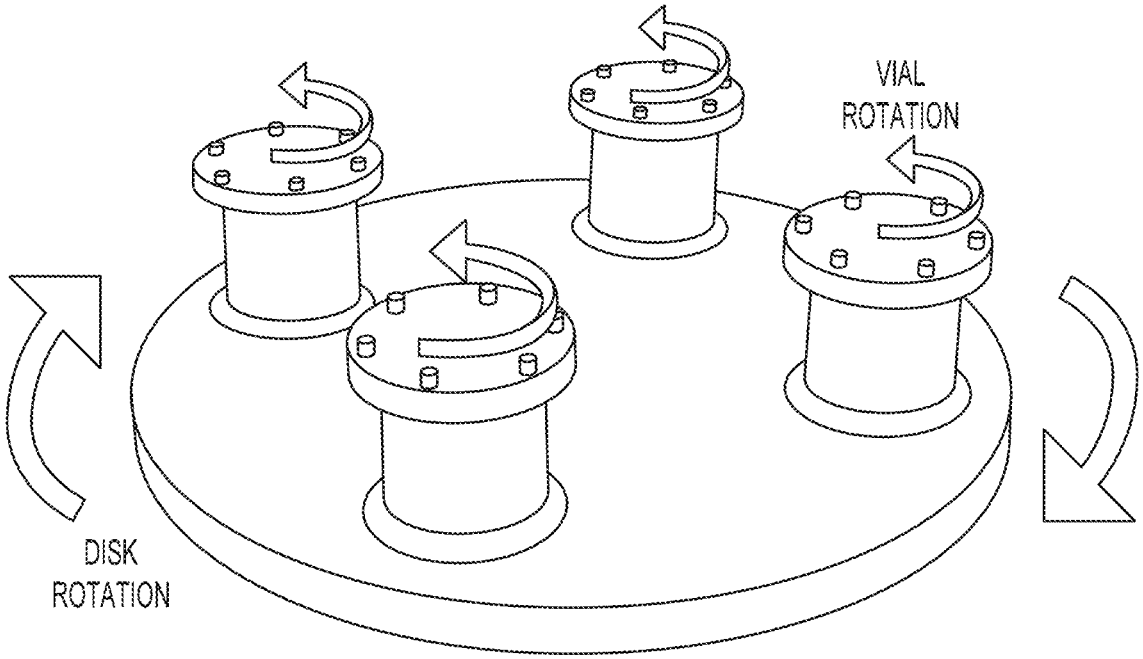
Figure 3C:
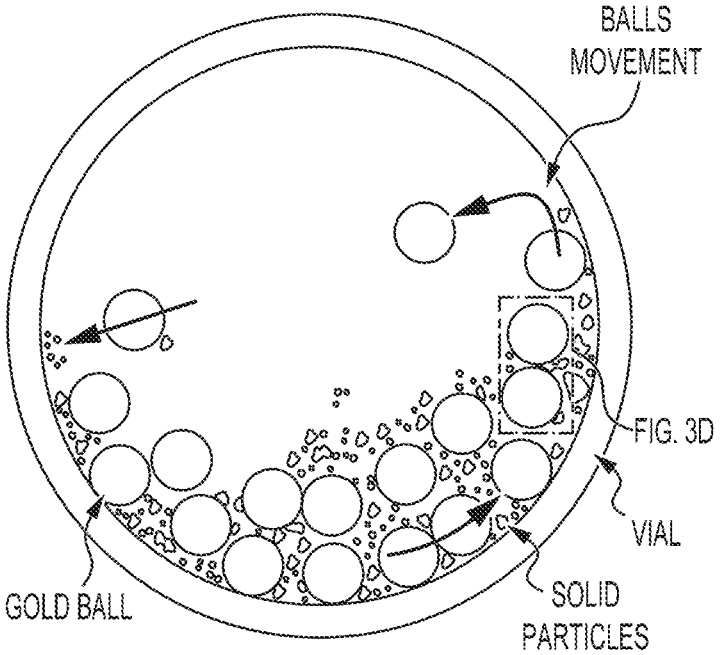
Figure 3D:
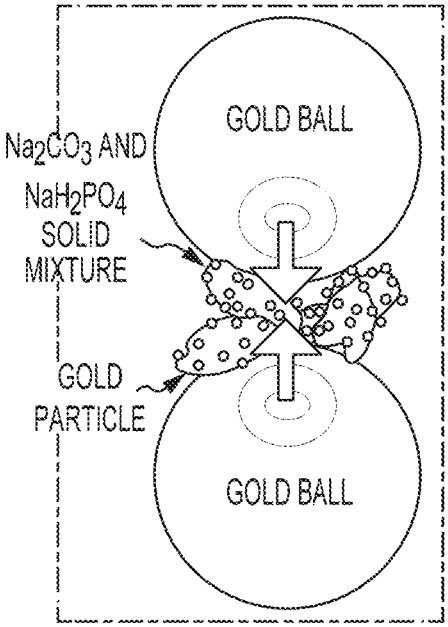
Figure 3E:
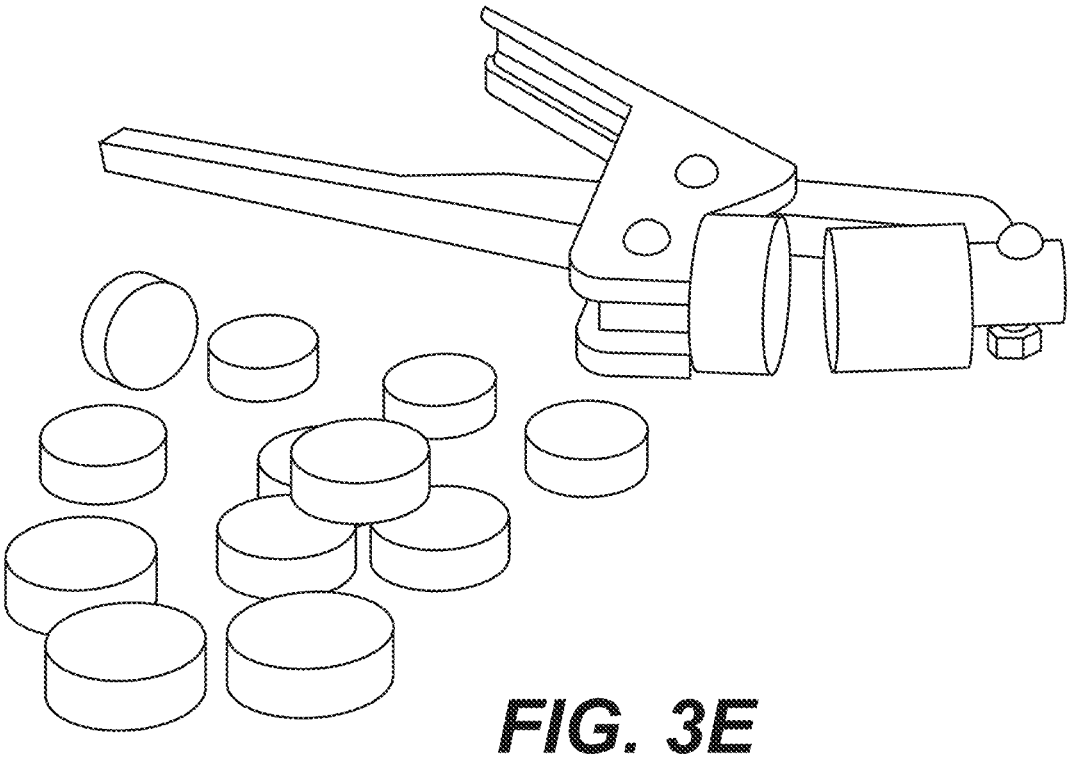

FIGS. 3A-3E are schematic diagrams showing the tablet fabrication process. FIG. 3A illustrates a reactive ball milling vial, noble metal mixing balls, such as gold mixing balls, and other alloy metal particles. FIG. 3B illustrates a high energy reactive ball milling functionality mechanism. FIGS. 3C and 3D schematically shows the inner vial mixing operation, with FIG. 3C showing the inner vial operation and FIG. 3D showing details of the interaction of the noble metal balls such as gold balls, with other metallic particles. The noble metal balls (e.g., gold balls) are mixed with the effervescent agents and other metallic particles. FIG. 3E shows the tablets after been constructed from the as-prepared powder mixture.

Figure 4:
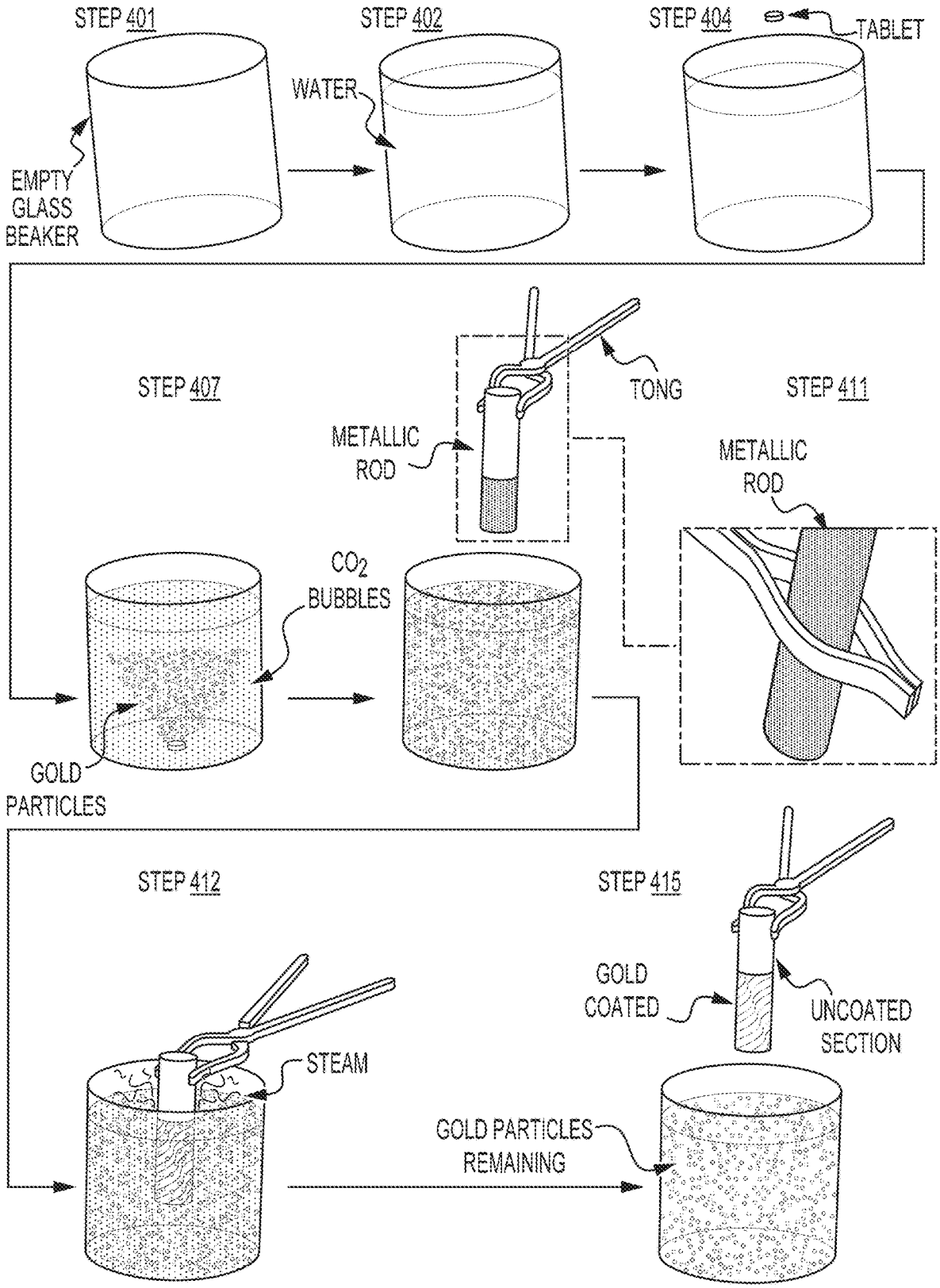
FIG. 4 is a diagram showing the process of coating of an object by quenching the object in a solution formed from placing the effervescent tablet in water.

As can be seen from FIGS. 3A-3E, the effervescent tablet fabrication process is implemented with high energy reactive ball milling then tablet pressing. FIG. 4 is a diagram showing the process of coating of an object by quenching the object in a solution of the effervescent tablet in water. The depicted process of coating shows, as a non-limiting example, coating a metallic rod by quenching the rod in a solution of the effervescent tablet in water.

In the process, a container is provided (step 401) and filled with water (step 402). The mixture of effervescent agents with solid particles are placed in the water (step 404). In the non-limiting example the mixture of effervescent agents with solid particles are provided in the form of a tablet such as described supra. The effervescent agents dissolve in the water and react in the water to release gold with the other alloys particles and release $CO_2$ (step 407), as an effervescent bath.

An object for coating, given in the non-limiting example, as a metallic rod, is heated and placed in the effervescent bath, thereby quenching the rod (steps 411 and 412). This results in coating the portion of the object exposed to the effervescent bath being coated with noble and/or platinum-group materials such as gold with other alloys to coat the rod with gold or with gold and the alloy metals. The coated object can then be removed (step 415). The effervescent bath retains gold with the other alloys particles, which can be extracted and re-used.

While a metallic rod is described, this is given as a non-limiting example. The process is compatible with any suitable material to which the noble and/or platinum-group metals can adhere. This can be a metallic object, an object with a metallic surface, a photoplated object or any other suitable object to which adherence of a noble and/or platinum-group material is possible.

The as-prepared effervescent tablet is dropped in container containing water, of pH 7, to start a chemical reaction between the tablet and the host liquid (i.e., the pH 7 water). The resulting chemical reaction between the as-prepared effervescent tablet and water will cause the tablet to gradually dissolve. As the dissolving process takes place, $CO_2$ gas (in the form of bubbles) will start to generate and the Au with other alloys particles will be released from the tablet. The buoyancy action of the bubbles will then cause the Au with other alloys particles to disperse within the hosting liquid, and thus producing the Au-based-water suspension. Once the tablet is fully dissolved, the high temperature metal is quenched in the suspension to cool it down. At this stage, the $CO_2$ bubbles will provide an even heat transfer mechanism along the quenched part from the coolant media, and thus will highly reduce the possibility of uneven expansion to the final product that is usually experienced by conventional water. Moreover, at the quenching phase, the hot metal will attract the dispersed particles to its surface into forming a thin coated layer of Au with other alloys. The adhesion of the thin layer would be high, which means that the thin film will be highly attached to the surface due to the thermally formed bound between the particles and the hot metallic exposed surface. The previous process will also result in the coated layer having a smooth surface finish (i.e., of low surface roughness), which is the case with most thermal coating approaches.

It is noted that the remaining Au with other alloys particles in the quenchant, after the quenching process is completed, can be easily regained through centrifugation of the used suspension quenchant. At least in theory, no Au with other alloys particles will be lost from the proposed quenching and coating method. The previously explained suspension production and $CO_2$ generation process from the as-prepared tablets, and hot metal quenching step is as depicted in FIG. 4.

Figure 5A:
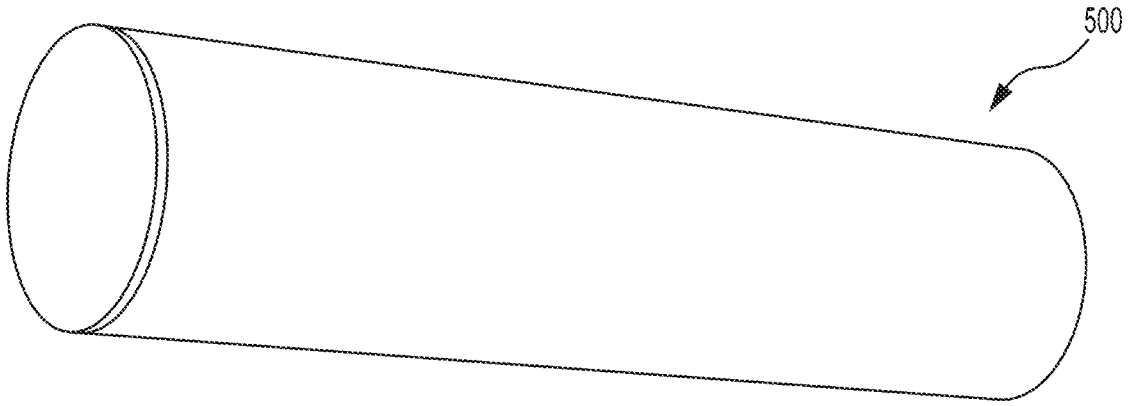
FIGS. 5A and 5B are diagrams showing the metallic part.
Figure 5B:
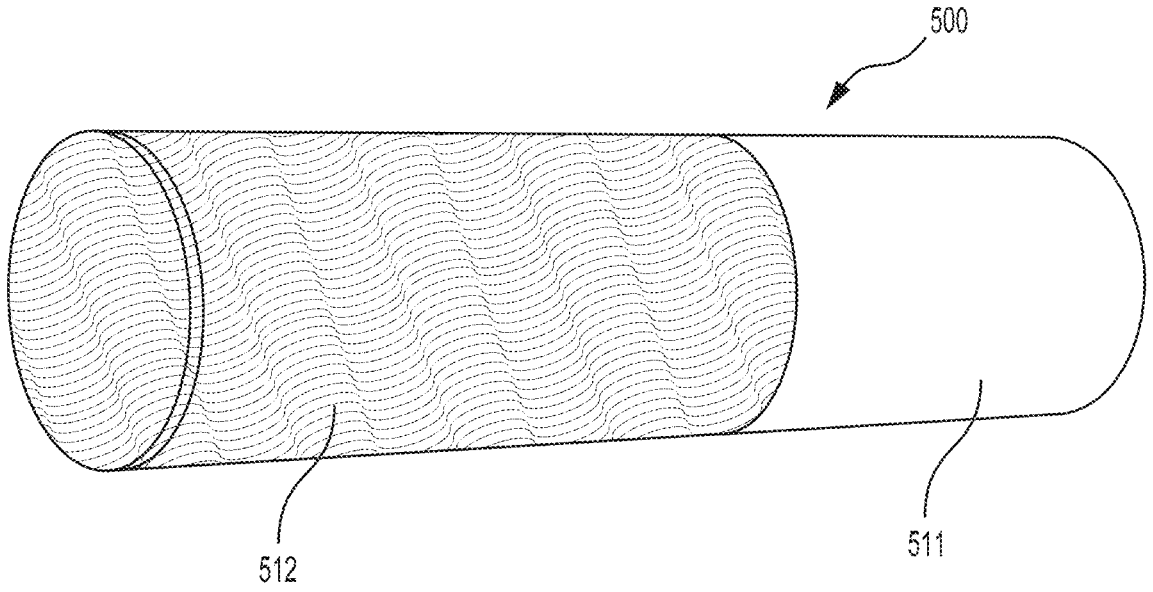

FIGS. 5A and 5B are diagrams showing the metallic part, depicted as rod 500. FIG. 5A shows the original uncoated rod. FIG. 5B shows the rod with an uncoated section 511 and a gold of different carat and color coated section 512. Gold of different carat and color coated section 512 results from quenching in the effervescent solution and coated by the proposed approach. The coated section 512 is left with an improved metallic part property along, having been coated with the gold of different carat and color.

Several effects are noted, regarding the produced suspension:

1. The as-fabricated tablet dimensions and shape is likely to influence the level of suspension stability.
2. Increasing the number of tablets would cause the volumetric concentration of Au with other alloys particles to increase in the suspension.
3. The temperature of the base fluid (i.e., water) will affect the rate of chemical reaction between the tablet and the liquid host. In general, rising the temperature of the base fluid would cause the reaction rate to increase but this would also mean that the $CO_2$ bubbles will be rapidly released from the tablet, and hence the Au with other alloys particles will have less mixing time within the base fluid. This would result in a lower suspension physical stability, and thus further studies are needed in this area. At this stage, it has been found advantageous to use water of temperatures between 20° C. to 30° C. to fabricate the suspension with good physical stability.
4. Using a base fluid (i.e., water) of higher or lower pH values (i.e., > or <than 7) to fabricate the suspension is possible but would require a change in the $NaH_2PO_4$:$Na_2CO_3$:Au with other alloys mass ratios to maintain the desired chemical reaction.
5. The physical stability of the suspension has a major influence on the liquid-solid mixture effective thermophysical properties. This is always the case with any suspension, where the optimum thermophysical properties can only be obtained when the dispersed particles are physically stable, and vice versa.

The disclosed technology can be used by researchers working on suspensions and for industrial application, such as metallic quenching and coating. Advantages of the proposed technique are:

1. First tablet-based integrated Au with other alloys-carbonation water suspension fabrication for metallic quenching.
2. A ready to use commercial product for producing Au with other alloys-carbonation water suspensions, which only requires water (i.e., no other mixing devices are needed).
3. Since no additional mixing instruments are required, this method is more feasible where Au with other alloys-carbonation water suspensions are required.
4. Increasing the concentration of the Au with other alloys particles will only require adding more tablets in the water.
5. The tablets can be used in labs, facilities, and even fields.
6. The described tablets will enhance the heat transfer capability of water and even the heat transfer along the quenched metal. This is because the dispersed Au with other alloys particles will cause the effective thermal conductivity of the mixture to rise, and the $CO_2$ bubbles will break the formation of air pockets at the quenched metal surface.

The disclosed technology provides Au with other alloys-carbonation water suspensions from just adding an as-prepared tablet to water, which can be used at any desired time. As such, it is one of easiest and robust approach to fabricate this type of advanced quenchant (i.e., Au with other alloys-carbonation water suspension) for metallic quenching and Au with other alloys coating purposes compared to all existing methods in the literature.

It is anticipated that the technique can be used for coating using metallic and semimetallic particles other than gold of different carats and colors and other noble and/or platinum-group metals. Therefore, different types of carbonated suspensions can be produced to form coatings of different types. Different parameters (e.g., tablet dimensions and shape, water temperature, and base fluid vial diameter) are expected to be effective in terms of dispersion physical stability and thermophysical properties.

CLOSING STATEMENT

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A method for fabricating an effervescent suspension for metallic quenching and coating purposes, comprising the steps of:

providing a mixture of effervescent agents with solid particles in a container of water, the mixture comprising a solid alkaline, a solid acid and noble and/or platinum-group metal particles as an effervescent bath, to produce a reaction in the water resulting in the release of $CO_2$ gas the mixture having a mass ratio of $NaH_2PO_4$ to $Na_2CO_3$ to gold (Au) particles with other alloys particles of 20.4:6:1, the $CO_2$ gas dispersing the noble and/or platinum-group metal particles in the water to provide the suspension;

heating an object for coating to a temperature below the object's melting point; and placing the object in the effervescent bath to provide a quenched metal coated with noble metal particles.

2. A method for fabricating an effervescent suspension for metallic quenching and coating purposes, comprising:

providing water in a container;

providing a mixture comprising a solid alkaline, a solid acid, and noble and/or platinum-group metal particles, wherein the solid alkaline comprises $Na_2CO_3$ powder, the solid acid comprises $NaH_2PO_4$ powder, and the noble and/or platinum-group metal particles comprise gold nanoparticles with other nanoparticle alloys, the mixture having a mass ratio of $NaH_2PO_4$ to $Na_2CO_3$ to gold (Au) nanoparticles with other nanoparticle alloys of 20.4:6:1;

adding the mixture to the water to produce a reaction in the water resulting in the release of $CO_2$ gas, the $CO_2$ gas dispersing the noble and/or platinum-group metal particles in the water to provide the suspension; and immersing a hot object to be coated, that has a temperature below its melting point, in the suspension, to provide a quenched object coated with noble and/or platinum-group metal particles.

3. The method for fabricating the effervescent suspension as recited in claim 2, wherein the hot object to be coated has a metal surface.

4. The method for fabricating the effervescent suspension as recited in claim 2, wherein the mixture comprises a tablet formed by:

mixing an acid powder and an alkaline powder to form a first mixture component;

mixing an acid powder, an alkaline powder, and noble and/or platinum-group metal powders to form a second mixture component; and providing a tablet press with a die for compressing the powder into a tablet.

5. The method for fabricating the effervescent suspension as recited in claim 2, wherein the mixture is formed by:

mixing an acid powder and an alkaline powder to form a first mixture component; and mixing an acid powder, an alkaline powder, and noble and/or platinum-group metal powders to form a second mixture component, wherein the process implements the reaction:

$$Na_2CO_3+NaH_2PO_4 \rightarrow NaHCO_3+Na_2HPO4.$$

6. An effervescent tablet-based method for fabricating a suspension for metallic quenching and coating purposes, comprising:

providing water in a container;

providing a tablet comprising a solid alkaline comprising $Na_2CO_3$ powder, a solid acid comprising $NaH_2PO_4$ powder, and a mixture of gold nanoparticles with other nanoparticle alloys;

adding the tablet to the water to produce a reaction in the water resulting in the release of $CO_2$ gas, the $CO_2$ gas dispersing the gold nanoparticles with the other nanoparticle alloys in the water to provide the suspension; and immersing a hot object to be coated that has a temperature below its melting point in the suspension to provide a quenched object coated with the gold nanoparticles and the other nanoparticle alloys, and wherein the tablet comprises a mass ratio of $NaH_2PO_4$ to $Na_2CO_3$ to gold (Au) nanoparticles with other nanoparticle alloys of 20.4:6:1.

7. The method as recited in claim 6, wherein the hot object to be coated has a metal surface.

8. The method as recited in claim 6, wherein the tablet comprises a mixture formed by:

mixing an acid powder and an alkaline powder to form a first mixture;

mixing an acid powder, an alkaline powder, and noble and/or platinum-group metal powders to form a second mixture; and providing a tablet press with a die for compressing the powder into the tablet, wherein the noble and/or platinum-group metal particles comprise gold microparticles or nanoparticles with other alloys in the form of microparticles or nanoparticles.

9. The method as recited in claim 6, wherein the tablet is formed by:

mixing an acid powder and an alkaline powder to form a first mixture; and mixing an acid powder, an alkaline powder, and noble and/or platinum-group metal powders to form a second mixture, wherein the process implements the reaction:

$$Na_2CO_3+NaH_2PO_4 \rightarrow NaHCO_3+Na_2HPO4.$$

* * * * *